United States Patent [19]

Pemberton

[11] Patent Number: 4,659,249

[45] Date of Patent: Apr. 21, 1987

[54] ROADWAY DESTRIPING

[76] Inventor: J. C. Pemberton, 9920 Sunset Ave., La Mesa, Calif. 92041

[21] Appl. No.: 776,292

[22] Filed: Sep. 16, 1985

[51] Int. Cl.[4] ..... E01F 9/08; E01C 23/16

[52] U.S. Cl. ..... 404/75; 404/9

[58] Field of Search ..... 404/75, 93, 9, 94, 14; 427/136, 137

[56] References Cited

U.S. PATENT DOCUMENTS 3,450,556 6/1969 Radcliffe et al. ..... 404/75

*Primary Examiner*—Stephen J. Novosad

*Assistant Examiner*—Bruce M. Kisliuk

*Attorney, Agent, or Firm*—Warren T. Jessup

[57] ABSTRACT

Unwanted roadway marking is obscured and gradually removed by abrasion from normal traffic over the roadway. Segments of color the same as the roadway are evenly distributed over the marking, as by speckling. From a distance, the color of the marking is effectively altered to the point where it is no longer recognized as a traffic sign. Thereafter, normal traffic steadily abrades the speckling and the underlying marking until both speckling and marking are completely worn away, leaving the original roadway, unmarked.

8 Claims, 7 Drawing Figures

ROADWAY DESTRIPING

This invention relates to processes for treating a road structure, specifically to in situ treatment of a roadway, and more specifically to traffic control markings on the roadway.

BACKGROUND OF THE INVENTION

Most roadways in the United States have lines painted thereon—longitudinally, laterally, and obliquely, to give guidance and direction to traffic traversing the road. From time to time it becomes advisable to change or eliminate the lines. For example, it may be desired to change a numeral setting forth a speed limit, e.g. "35", to "40". While it is a simple matter to paint "40" adjacent the "35", the "35" must be simultaneously obscured to avoid confusion.

The present practice is to abrade the old lines ("35"), as by sandblasting, at substantially the same time as any new marking ("40") applied. This is quite expensive.

The present invention offers a much less expensive method or process of in effect obscuring the unwanted marking.

BRIEF SUMMARY OF THE INVENTION

The present invention proceeds on the premise that effective elimination of the unwanted marking does not require complete erasure, but only sufficient obscuring that it will no longer be recognized by road users as a traffic sign. This is done by overpainting the marking with segments of a color substantially the same as the roadway itself. The segments are substantially evenly distributed over the marking and cover approximately one-half the area of the marking. Each segment is sufficiently small that, when seen from a distance, the segments and the unpainted portions of the marking blend together and appear as a blend of a color between that of the marking and of the road. Traffic then abrades both the painted and unpainted areas, and the net effect continues as a blend, until the segments and the marking have worn completely away, leaving the unmarked roadway.

DETAILED DESCRIPTION

Figure 1:
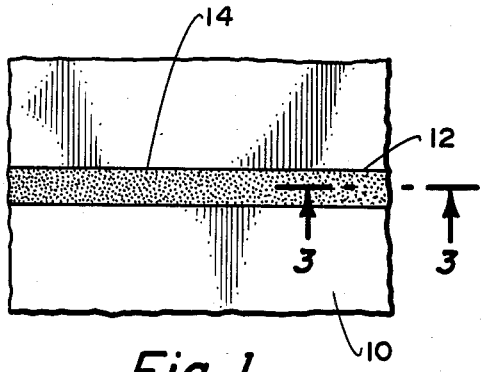
FIG. 1 is a plan view looking down on a roadway having a marking painted thereon, exemplified here as a center stripe.

A first embodiment of the invention is shown in FIG. 1, where there is depicted the surface 10 of a passageway such as a roadway. Along the center of the roadway is a marking such as striping 12. The striping 12 is of a color contracting with that of the road surface 10. Typically the roadway may be of asphalt, which appears as black or gray; and the striping may be white or yellow. In case of concrete roadway, the appearance is a lighter gray, and the striping a contrasting white or yellow. In the example here shown and described, the road 10 will be represented as asphalt, and the striping 12, as white paint.

In accordance with this invention the striping 12 has been painted or speckled with specks 14 of black paint, comprised of a mixture of hot tar and fine sand. "Typically the specks 14 will be of substantially the same color as the roadway 10. Full color identity is not necessary however; the color of 14 may be any color which is substantially indistinguishable from the color of the roadway 10. For example, if the roadway is black or gray, the specks 14 could be a dark, cold color such as green or blue. To a driver, the two portions of the roadway, both at roadway 10 and the striping at 12/14 would appear to be a blend; and this blending would persist throughout the transition from FIG. 3 through FIG. 5." The paint segments 14 are small and are distributed generally even over the surface of the white stripe 12, so as to cover approximately one-half of the surface of the strip 12.

If viewed closely the white areas 12, and the black areas or segments 14 are discretely discernable. However, when viewed from a distance, and at an oblique angle, the two colors blend together into a dark gray, approaching the black or gray of the surface 10.

Figure 2:
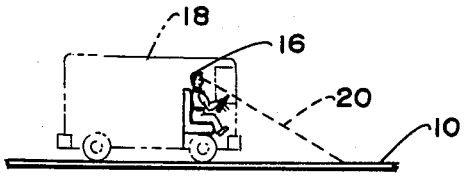
FIG. 2 is an elevation, somewhat schematic, of a vehicle traversing the roadway of FIG. 1.

Thus, as shown in FIG. 2, the driver 16 of a motor vehicle 18 looks down at the roadway 10 along a line 20 at an oblique angle and from an appreciable distance. To the driver's eyes the two colors 12 and 14 meld or blend and appear as a substantially homogeneous mix—in this case a dark gray. The previously all-white striping 12 has disappeared, and is no longer recognized as a roadway guide.

The speckling may be applied at random, as by a hot tar splatter spray gun and still be distributed generally evenly over the striping 12. The gun should be adjusted so that the smallest dimension across a speck on any axis is not over one inch. The spraying is done over the surface 12 until approximately one half of the surface 12 has been covered with specks 14.

Figure 3:
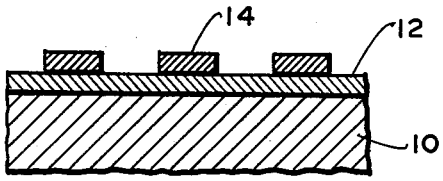
FIG. 3 is a fragmentary vertical section on line 3—3 of FIG. 1.

With the roadway 10 thus painted, the layers 10, 12, and 14 appear as shown in vertical section FIG. 3.

Figure 4:
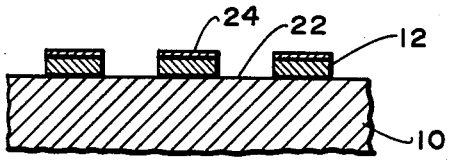
FIGS. 4–6 are the same as FIG. 3, showing the several stages which the roadway striping undergoes in the practice of this invention.
Figure 5:
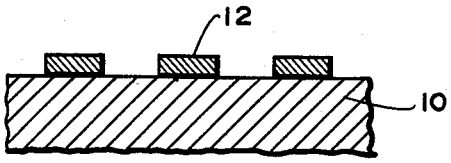

With passage of traffic over roadway 10 including striping 12, the segments 14 and the exposed portion of striping 12 wear away or abrade. "Both 12 and 14 are abraded with substantial vigor by contact with the user, e.g., an automobile tire. It is to be understood that the thicknesses shown in FIGS. 3 through 5 are greatly exaggerated for graphic clarity. In practice, the thickness of the markings (paint) at 12 and 14 is several magnitudes smaller than the other dimensions of the structure, e.g., the width of stripe 12, which may be about 5 inches, compared to a paint thickness of about 0.02 inch—a ratio of over 200 to 1. Thus the automobile tire will abrade away the under-marking substantially as fast or even faster than the over-marking 14." It is preferred to select the thickness and durability of segments 14 such that the exposed portion of 12 will wear completely away before the segments 14. Thus, as shown in FIG. 4, a stage is reached where the exposed striping 12 has disappeared, as shown at 22, revealing the roadway surface 10; while a thin layer of the paint segment 14 remains, as shown at 24. Since both the surface 10 and the paint segment 14 are of the same color (here black or gray), the white striping will for a time appear to be completely obliterated. In any event, it is desirable that the segment 14 not abrade away completely before the exposed paint 12.

In due course, continued traffic abrasion produces the condition illustrated in FIG. 5, which to the eyes of the driver 16 will appear the same as FIG. 3. That is, it will appear to be a homogeneous gray, midway between the black or dary gray of the roadway 10 and the white of the striping 12. It will have lost its identity as a white line, and will no longer be recognized as a road marker. The areas 14 that showed black in the FIG. 3 stage will appear as white 12 in the FIG. 5 stage; and the white areas 12 of FIG. 3 will appear as the black roadway 10.

Figure 6:
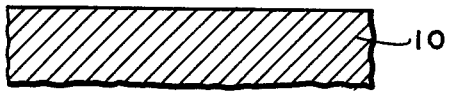

Finally the white segments 12 of FIG. 5 will abrade away, leaving the all black (or gray) roadway 10, as shown in FIG. 6.

Figure 7:
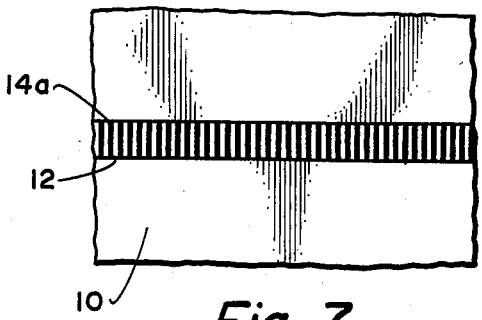
FIG. 7 is a view similar to FIG. 1 showing an alternate way of practicing this invention.

The paint segments 14 need not be specks, but may be bars, as shown at 14*a* in FIG. 7. Such segments may be easily applied by a marking wheel; such is particularly suited to overpainting linear markings such as a center stripe 12. The bars 14*a* should be sufficiently narrow so that they will homogeneously blend with the unpainted portions of the stripe 12 which lie between the bars or segments 14*a*.

While the invention has been specifically described as applied to longitudinal striping, it is equally applicable to any marking on the roadway surface, such as lines transverse or oblique to the roadway, or letters or numbers, such as "STOP", or "35" (representing, e.g. the speed limit).

What is claimed is:

1. In a process for de-marking or de-striping a passageway surface, said surface being a first color, and the marking thereon being a second, contrasting color, the step of painting, over said marking, a color substantially indistinguishable from said first color, said painting being applied in discrete segments distributed generally evenly over said marking, and covering approximately one-half of the total area of said marking, the smallest dimension of any given segment being sufficiently small that when the surface is viewed by a person in traversing the passageway, the two contrasting colors appear to be a blend approaching said first color.

2. Process of claim 1 wherein:

said smallest dimension is about 1 inch.

3. Process of claim 1, including:

abrading said segments and said marking by passage of traffic thereover, until said segments of said color indistinguishable from said first color and the portions of said marking of said second color not covered by said segments have disappeared, abrading the remainder of said marking by passage of traffic thereover, until all of said marking has disappeared, leaving only said first color appearing.

4. Process of claim 3, wherein:

the complete abrading of said segments occurs after the complete abrading of said portion of said marking, whereby, for a time, all of said passageway surface appears to be of said first color.

5. Process of claim 3 wherein:

said smallest dimension is about 1 inch.

6. Process of claims 1, 3, 2, 4 or 5 wherein:

said segments comprise bars of said color substantially indistinguishable from said first color.

7. Process of claims 1, 3, 2, 4 or 5, wherein:

said segments comprise speckles.

8. Process of claims 1, 3, 2, 4, or 5 wherein said first color is black or gray, and said second color is white or yellow.

* * * * *